US005178780A

United States Patent [19]

Desaar

[11] Patent Number: 5,178,780

[45] Date of Patent: Jan. 12, 1993

[54] DEVICE FOR CLOSING THE POURING HOLE OF A RECEPTACLE FOR LIQUID METAL

[75] Inventor: René Desaar, Grâce-Hollogne, Belgium

[73] Assignee: Recherches Et Developpments Dessar, Belgium

[21] Appl. No.: 689,255

[22] PCT Filed: Aug. 16, 1990

[86] PCT No.: PCT/BE90/00045

§ 371 Date: Jun. 12, 1991

§ 102(e) Date: Jun. 12, 1991

[87] PCT Pub. No.: WO91/02611

PCT Pub. Date: Mar. 7, 1991

[30] Foreign Application Priority Data

Aug. 18, 1989 [BE] Belgium ..... 0890086

[51] Int. Cl.[5] ..... B22D 41/36

[52] U.S. Cl. ..... 222/592; 222/600

[58] Field of Search ..... 222/600, 592, 591, 594, 222/597; 266/236

[56] References Cited

U.S. PATENT DOCUMENTS

| | | | |
|---|---|---|---|
| 311,902 | 2/1885 | Lewis | 222/600 |
| 3,435,884 | 4/1969 | Orris et al. | 222/600 |
| 3,685,707 | 8/1972 | Shapland | 222/600 |
| 4,376,501 | 3/1983 | Hafner et al. | 222/600 |

FOREIGN PATENT DOCUMENTS

| | | |
|---|---|---|
| 3307193 | 9/1984 | Fed. Rep. of Germany . |
| 59-64153 | 4/1984 | Japan . |
| 2213412 | 8/1989 | United Kingdom . |

OTHER PUBLICATIONS

Patent Abstacts of Japan, vol. 8, No. 170 (M-315)(1607) Dec. 1984.

Patent Abstracts of Japan, vol. 8, No. 170 (M-315) (1607), Aug. 7, 1984.

*Primary Examiner*—S. Kastler

*Attorney, Agent, or Firm*—Sughrue, Mion, Zinn, Macpeak & Seas

[57] ABSTRACT

A fixed plate member, and a movable plate member is mounted against the fixed plate member. The fixed plate member consists of a fixed metal support plate having a plane outer metal surface and a cutout in which is accommodated a wear part made of refractory material which is pierced with at least one pouring orifice. The lower refractory surface of the refractory wear part is flush with the plane outer metal surface of the fixed metal support plate. The major portion of the rubbing surface of the fixed plate member and contact with the movable plate member consists of only the plane outer metal surface, while only the remaining minor portion consists of the lower refractory surface of the wear part. The fixed metal support plate contains a cooling chamber for holding cooling fluid which circulates to the plane outer metal surface of the fixed metal support plate via an orifice formed in the fixed metal support plate which also has a groove communicating with the cooling chamber and running along a circumference of the cutout in order to circulate the cooling fluid to cool the wear part.

7 Claims, 4 Drawing Sheets

DEVICE FOR CLOSING THE POURING HOLE OF A RECEPTACLE FOR LIQUID METAL

BACKGROUND OF THE INVENTION

The present invention relates to a device for closing the pouring hole of a steel-making or metallurgical receptacle such as a pouring ladle, ingot mould or continuous-casting distributor, and more particularly to a device with a moveable plate.

A conventional pouring-hole closing device is composed essentially of a plate made of refractory material which is accommodated in a metal casing fixed under the bottom of the receptacle and of a moveable plate, likewise made of refractory material, which is mounted against the fixed plate so that it can be displaced by a translational or rotational movement in order to close the pouring orifice of the fixed plate or to position a pouring orifice with which it is provided opposite the pouring orifice of the fixed plate.

When the liquid metal is poured, the stream of metal flows out through the pouring channel of the internal nozzle, made of refractory material, of the receptacle and passes through the pouring orifices in the elements, made of refractory material, of the fixed plate and of the moveable plate of the closing device. The molten metal erodes the wall of the pouring channel and causes fairly rapid wear of the wall of the pouring orifices in the refractory elements of the fixed and moveable plates owing to the high temperature of the liquid metal. In addition, owing to the temperature a decarburisation of the binder used in the manufacture of the refractory plates occurs, which leads to a deterioration of the rubbing surfaces of the two plates, which deterioration hinders the sliding of the moveable refractory plate against the fixed refractory plate during each pouring operation.

The wear of the refractory material around the pouring orifice and the deterioration of the rubbing surfaces makes it necessary to replace the refractory plates fairly regularly after a certain number of pouring operations. These replacements are obviously costly in terms of refractory material.

SUMMARY OF THE INVENTION

The object of the present invention is, on the one hand, to make these replacements less expensive and, on the other hand, to improve the sliding of the moveable plate against the fixed part.

This objective is achieved, in accordance with the invention, by means of a device for closing the pouring hole of a steel-making or metallurgical receptacle, which device is distinguished in that the fixed plate consists of a metal support plate having a plane outer surface and exhibiting a cutout in which is accommodated a wear part made of refractory material which is pierced with at least one pouring orifice, the lower face of the wear part being flush with the plane outer surface of the support plate, so that the rubbing surface of the fixed plate in contact with a moveable plate consists of a metal surface for the most part and of a refractory surface of limited extent.

In a particular embodiment, the wear part has a rim cooperating with a corresponding rim provided on the wall of the cutout.

By virtue of the invention, it is sufficient to replace the wear part alone after a certain number of pouring operations while retaining the metal support plate, which is considerably more convenient, quicker and less costly than if the entire fixed plate has to be replaced, as is the case with the conventional closing devices. The same metal support plate can thus be used for a large number of pouring operations with the simple replacement of the wear part.

Advantageously, the support plate has a cooling chamber on its inner face. In addition, the metal support plate may have a groove running along the circumference of the cutout in order to circulate a cooling fluid.

The moveable plate of the closing device according to the invention consists of a metal support plate pierced with at least one cutout in which is accommodated a wear part made of refractory material, through which at least one pouring orifice passes.

By virtue of the fact that the rubbing surface of the wear part of the moveable plate slides against a fixed surface which is for the most part metal, the sliding is performed more easily and with less wear of the surface of the moveable refractory wear part. And the cooling of the metal support plate and the wear part of the fixed plate further adds to the lessening of the deterioration of the refractory surfaces and to the improvement of the sliding of the moveable plate against the fixed plate in accordance with the invention.

Other aspects of the invention will become apparent on reading the description which follows, in which the invention is explained in greater detail with the aid of the accompanying drawings, in which:

DESCRIPTION OF PREFERRED EMBODIMENTS

Figure 1:
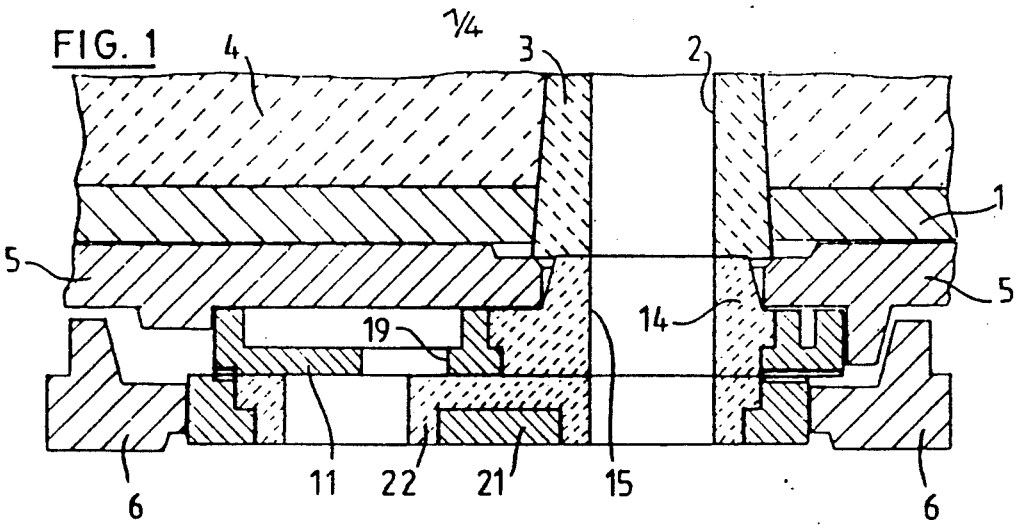
FIG. 1 is a sectional view of an exemplary embodiment of the device according to the invention, mounted under an ingot mould.

With reference to FIG. 1, an exemplary embodiment of a pouring-hole closing device according to the invention can be seen. This device is mounted under the bottom 1 of an ingot mould having a pouring hole 2 delimited, as is known per se, by an internal nozzle 3 made of refractory material, constructed in the refractory lining 4 of the ingot-mould bottom. The device for closing the pouring hole comprises a fixed plate which is fixed under the ingot mould and a moveable plate which is mounted so as to be able to slide against the fixed plate under the action of a drive mechanism (not shown), known per se.

Figure 4:
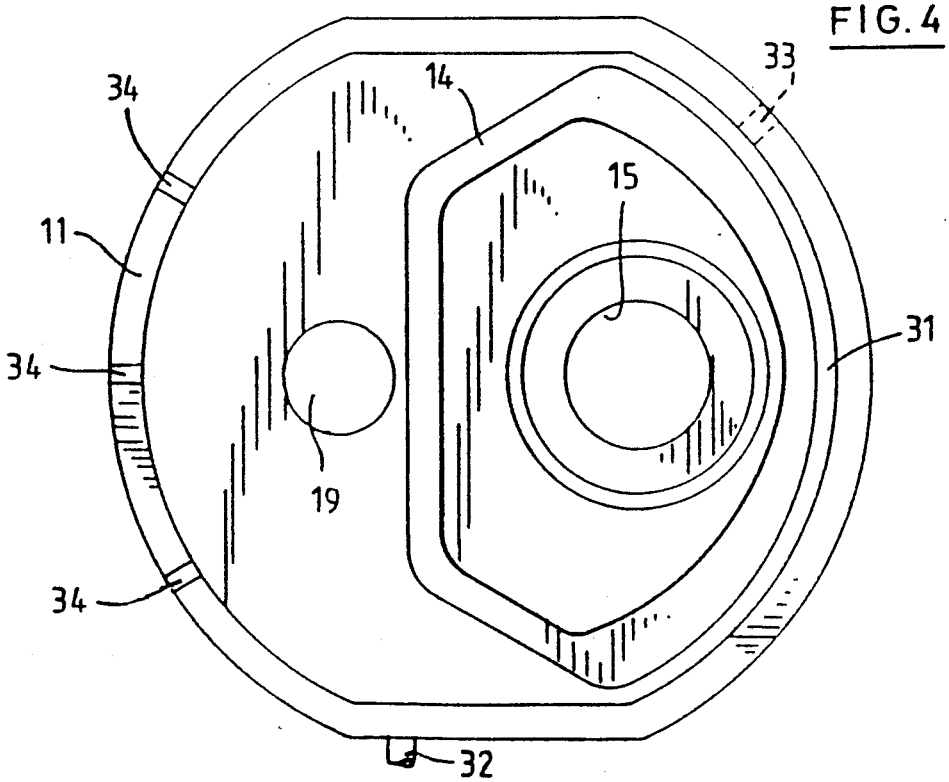
FIG. 4 is a plan view of the fixed plate shown in FIG. 2.
Figure 5:
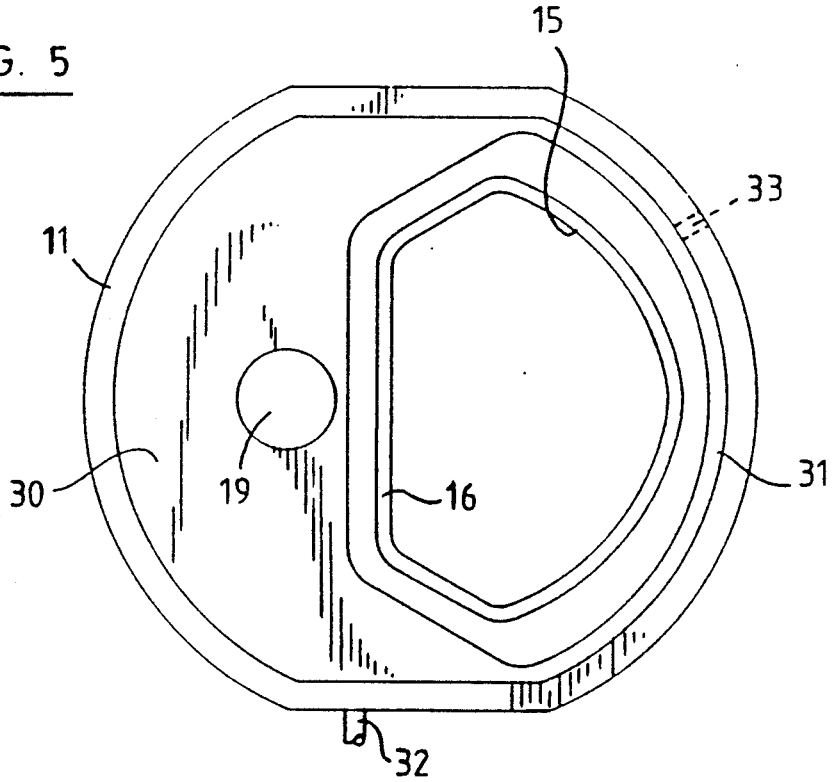
FIGS. 5 and 6 are plan views of the parts constituting the fixed plate shown in FIG. 2.
Figure 6:
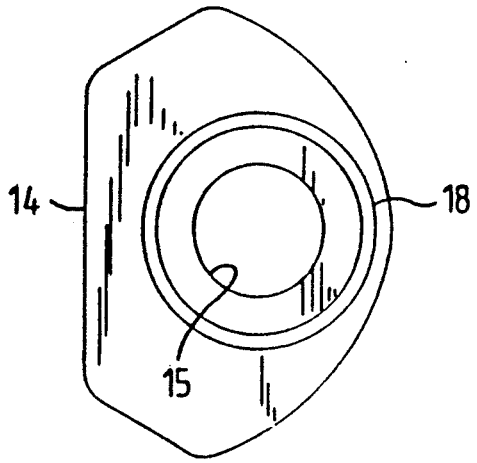

The fixed plate is described first of all with the aid of FIGS. 2 to 6. Fixed under the ingot mould is a metal mounting casing 5 (seen partially in FIG. 1), in which is mounted a metal support plate 11, made of stainless steel with a polished surface, having a plane horizontal outer face 10A. In the example illustrated, the metal part 11 is formed with a vertical peripheral rim 12 projecting from its inner face. Formed in the support plate 11 is a cutout 13, in which is fitted a part 14 made of refractory material through which passes a cylindrical orifice 15 which is placed in alignment with the pouring hole 2 of the ingot mould or other metallurgical or steel-making receptacle. The upper face of the refractory part 14 is intended to be constructed under the calibration washer, which is provided at the end of the internal nozzle. The parts 11 and 14 may be of any form in plan. The inner horizontal profile of the cutout 13 and the outer horizontal profile of the part 14 are preferably chosen so as to prevent the movement of the refractory part 14 in its housing. FIGS. 4, 5 and 6 illustrate an exemplary profile of the parts 11 and 14.

On the circumference of the refractory part 14 there is provided a rim 16 which is intended to cooperate with a corresponding rim 17 expediently formed on the side wall of the cutout 13. The refractory part 14 has an outer face 10B which is flush with the outer surface 10A of the metal support plate 11, with a small surface compared to the total surface which serves as rubbing surface in contact with the moveable plate, which rubbing surface is for the most part metal.

Since it is the refractory part 14 in which is formed the pouring orifice which is eroded as the number of pouring operations increases, it is sufficient to replace this part 14 alone, which is considerably more convenient, quicker and less expensive than if the entire plate 11 has to be replaced, as is the case in the conventional constructions. The same metal support plate 11 can thus be used for a large number of pouring operations with the simple replacement of the refractory part 14 or wear part, which represents a considerable saving in investment costs.

Figure 2:
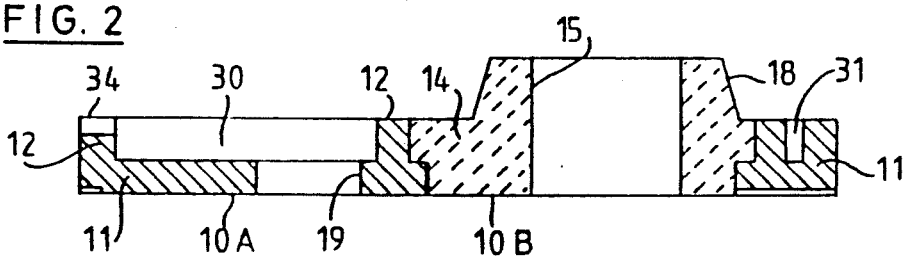
FIG. 2 shows, in particular, the fixed plate represented in FIG. 1.
Figure 3:
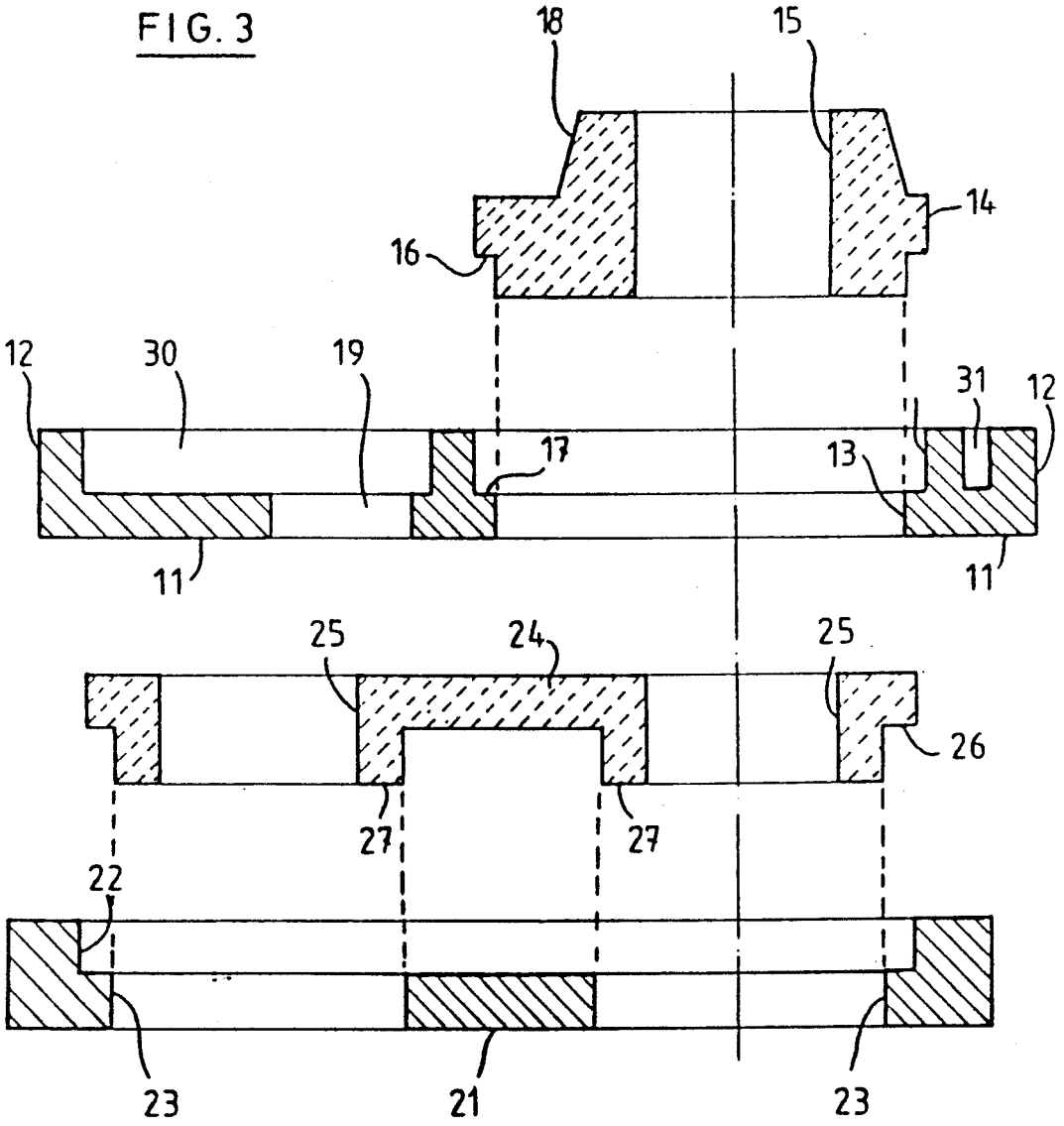
FIG. 3 is an exploded view, in section, of the fixed and moveable plates represented in FIG. 1.

In the exemplary embodiment illustrated in FIGS. 1 to 3, the refractory part 14 has a skirt 18 which projects from the top of the part so as to be accommodated in a recess provided in the calibration washer of the internal nozzle 3. This prevents the destruction of this washer during the replacement of the refractory wear part 14. In contrast, in the known constructions the calibration washer generally has a projecting flange on which the conventional refractory plate fits, and this projecting flange is frequently destroyed during the replacement of the refractory plate.

In the preferred embodiment illustrated, the metal support plate 11 is advantageously formed with rims 12 so as to create on the inner face a cooling chamber 30. The latter communicates with a groove 31 which runs along the circumference of the cutout 13 and hence along the circumference of the refractory part 14 in order to circulate a cooling fluid, for example air. The cooling fluid may, for example, be injected via a conduit 32 connected to a fluid-supply source and the cooling fluid may be evacuated via an evacuation orifice such as, for example, 33. In this way, the refractory part 14 is cooled during the molten metal pouring operations, thus reducing the deterioration of the refractory material owing to the high temperature. At the same time, the lowering of the temperature of the support plate 11 and of the refractory part 14 also brings about a reduction of the temperature of the moveable plate adjoining them. The orifice 19 formed in the support plate 11 expediently permits the passage of cooling fluid to the outer face 10A of the support plate 11, that is to say permits the cooling fluid to be brought to the rubbing surface in contact with the moveable plate, thus improving the sliding of the moveable plate against the fixed plate 11–14. Discharge channels 34 may advantageously be provided in the lateral rim 12 of the support plate (FIG. 4 shows three of them by way of example) for the removal of refractory material dust, which is detached from the moveable plate during the rubbing thereof against the fixed plate.

Figure 7:
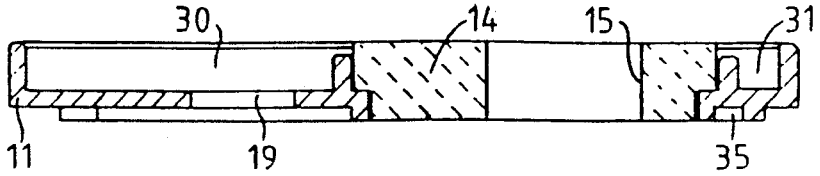
FIGS. 7 and 8 illustrate two exemplary alternative embodiments of the fixed plate in accordance with the invention.
Figure 8:
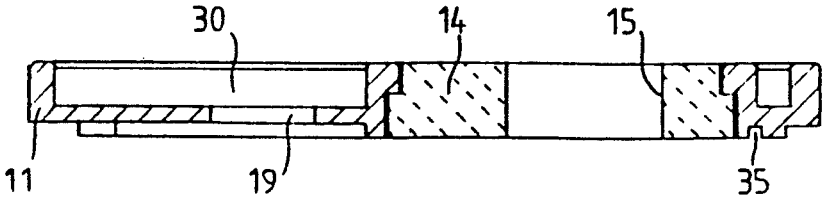

The metal support plate 11 and the refractory part 14 may, of course, have various embodiments. FIGS. 1 and 2 show, by way of example, an embodiment in which the refractory part has a projecting skirt 18. FIGS. 7 and 8 represent two other exemplary embodiments in which the refractory part 14 has no projection on its upper face. Furthermore, in these two alternative embodiments, the outer face of the metal support plate 11 has a groove 35 in communication with a cavity 36 to facilitate the circulation of air around the rubbing surfaces and to reduce the metal rubbing surface. The embodiment of FIG. 8 differs again from that of FIG. 7 in that the peripheral rim of the refractory part 14 is inverted. In the example of FIG. 7, the refractory part 14 is placed on the side of the inner face of the support plate 11. The replacement of the refractory wear part 14 requires the removal of the metal support plate 11, it being necessary for these two parts to be mounted together in the mounting casing fixed under the receptacle. With the embodiment of FIG. 8, on the other hand, the refractory wear part 14 can be replaced without removing the metal support plate 11.

Figure 9:
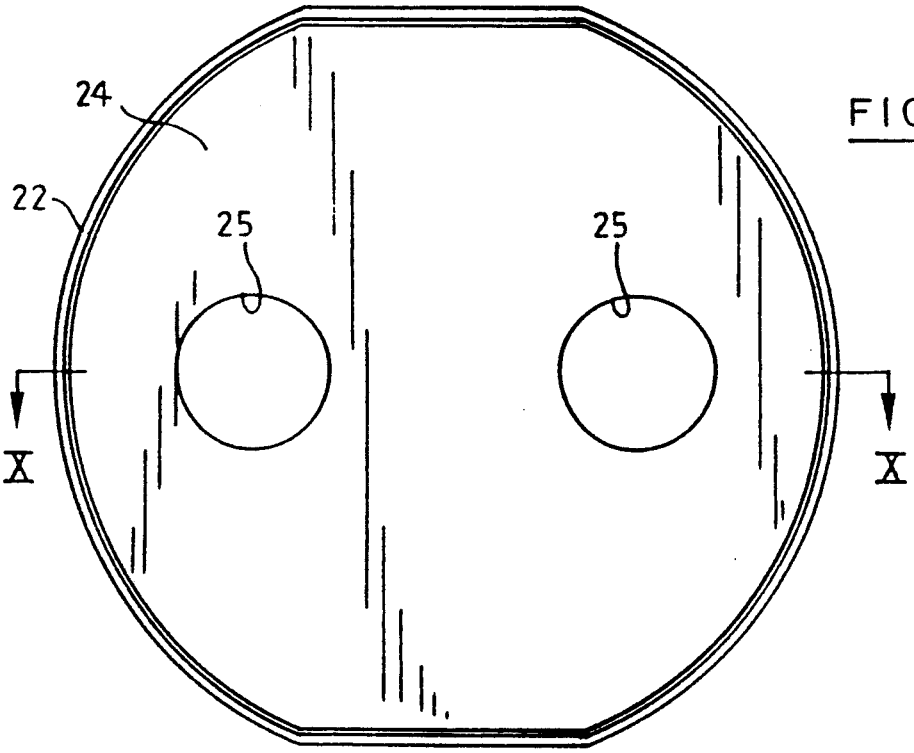
FIG. 9 is a top view of the moveable plate shown in FIG. 1.
Figure 10:
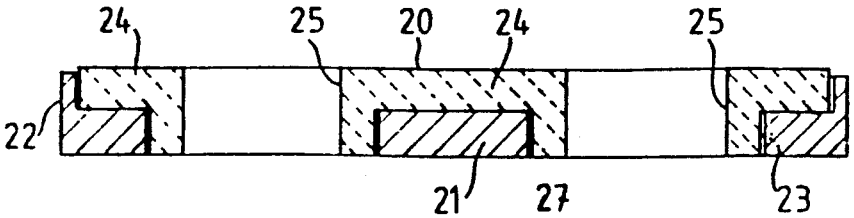
FIG. 10 is a view in section along the line X—X of FIG. 9.

The moveable plate of the device for closing the pouring hole may also be constructed, in accordance with the invention, with a wear part. An exemplary embodiment is illustrated in FIGS. 9 and 10, FIG. 9 being a top view and FIG. 10 being a sectional view. The moveable plate comprises a metal support plate, made of stainless steel with a polished surface for example, having at least one cutout 23 in which is fitted a part 24 made of refractory material, through which a pouring orifice 25 passes. In the embodiment illustrated, the refractory part 24 is formed with two pouring orifices 25, but the number of orifices could be other than two. The refractory part 24 rests on rims formed inside a vertical peripheral rim 22 provided on the upper face of the metal support plate 21.

The upper face 20 of the refractory part 24 extends slightly beyond the edge of the peripheral rim 22. This face constitutes the rubbing face bearing against the rubbing face 10 of the fixed plate when the metal support plate 21 is mounted in its mounting casing 6 (see FIG. 1) coupled to a drive mechanism, known per se. When the moveable plate 21–24 is thus put into place on a steel-making or metallurgical receptacle, one pouring orifice 25 is in alignment with the pouring orifice 15 of the fixed plate and with the pouring hole 2 of the receptacle. The other pouring orifice or the other pouring orifices serve as standby reserve orifices, ready to be placed in the operating position under the pouring hole 2 by sliding, with a translational or rotational movement, the moveable plate against the fixed plate. The collars 27 which surround the pouring orifices 25 on the outer face of the moveable plate serve for the connection of an external nozzle (not shown).

Figure 11:
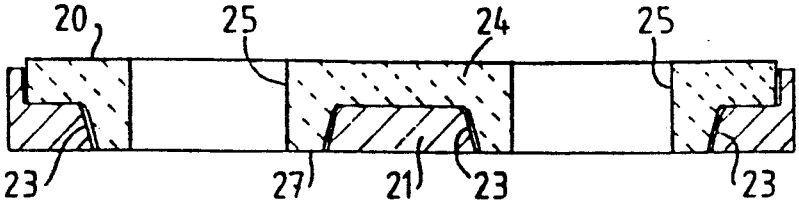
FIG. 11 illustrates an exemplary alternative embodiment of the moveable plate shown in FIG. 10.

In the same way as the construction of the fixed plate in accordance with the invention, in which the part made of refractory material is limited to the wear part surrounding the pouring orifice, the construction of the moveable plate as explained hereinabove has the advantage of helping to make the replacement of the worn refractory elements considerably less expensive than in the conventional constructions. It should also be noted that the wear of the rubbing surface of the refractory part 24 is less than in the conventional constructions, since this surface rubs here, for the most part, against a metal surface 10A. In addition, this facilitates the sliding of the hot parts against one another. To facilitate the installation of the refractory wear part 24 in the cutouts 23 and also to facilitate the removal of this wear part, the flanks of the cutouts 23 may expediently be oblique, as illustrated in FIG. 11.

It is understood that the embodiments of the invention described in the text above are examples given by way of illustration and the invention is in no way limited to these examples. Any modification, any variation and any equivalent arrangement must be considered to be within the scope of the invention.

I claim:

1. In a device for closing the pouring hole of a steel-making or metallurgical receptacle, said device comprising a fixed plate member mounted under the pouring hole of a receptacle and a movable plate member mounted against the fixed plate member so that the movable plate member can be displaced relative to the fixed plate member, thereby presenting a rubbing surface of the movable plate member against a rubbing surface of the fixed plate member, the improvement wherein:

the fixed plate member comprises a fixed metal support plate (11) having a plane outer metal surface (10A) and a cutout (13) in which is accommodated a wear part (14) made of refractory material which is pierced with at least one pouring orifice (15);

a lower refractory surface (10B) of the refractory wear part (14) is flush with the plane outer metal surface (10A) of the fixed metal support plate (11);

a major portion of said rubbing surfaces of the fixed plate member in contact with the movable plate member consists of the plane outer metal surface (10A), and only a remaining minor portion consists of the refractory surface (10B);

the fixed metal support plate (11) has on an inner face thereof a cooling chamber (30) which is adapted to hold cooling fluid and which communicates with the plane outer metal surface (10A) of the fixed metal support plate (11) via an orifice (19) formed in the fixed metal support plate (11); and the fixed metal support plate (11) has a groove (31) communicating with said cooling chamber (30) and running along a circumference of the cutout (13) in order to circulate a cooling fluid for cooling the wear part (14).

2. Device according to claim 1, wherein the wear part (14) has a rim (16) cooperating with a corresponding rim (17) on the wall of the cutout.

3. Device according to claim 1, wherein the fixed metal support plate (11) has a lateral rim (12) containing at least one discharge channel (34) for dust.

4. Device according to claim 1, wherein the wear part (14) has a shirt (18) projecting from an upper face of the wear part around the pouring office (15).

5. Device according to claim 1, wherein the fixed metal support plate (11) is mounted in a metal mounting casing (5) fixed to the steel-making or metallurgical receptacle.

6. Device according to claim 1, wherein the movable plate member comprises a second metal support plate (21) pierced with at least one cutout (23) in which is accommodated another wear part (24) made of refractory material and through which said at least one pouring orifice (25) passes.

7. Device according to claim 6, wherein the second metal support plate (21) is accommodated in a metal mounting casing (6) coupled to a drive mechanism to displace the second metal support plate (21) relative to the fixed metal support plate (11) of the fixed plate member.

* * * * *